US005330069A

United States Patent [19]

Jamison et al.

[11] Patent Number: 5,330,069

[45] Date of Patent: Jul. 19, 1994

[54] BI-FOLD LID FOR CONTAINER

[75] Inventors: Barry Jamison, Cincinnati, Ohio; Eric Stein, Tega Cay, S.C.

[73] Assignee: Buckhorn Material Handling Group, Inc., Milford, Ohio

[21] Appl. No.: 45,180

[22] Filed: Apr. 12, 1993

[51] Int. Cl.[5] ..... B65D 43/4

[52] U.S. Cl. ..... 220/335; 220/334; 220/343

[58] Field of Search ..... 220/335, 343, 334

[56] References Cited

U.S. PATENT DOCUMENTS

| | | | |
|---|---|---|---|
| 1,445,816 | 9/1921 | Bailey . | |
| 1,759,237 | 10/1925 | McClure . | |
| 2,365,231 | 12/1944 | Wegman | 220/343 |
| 2,770,389 | 11/1956 | Drakoff | 220/334 |
| 3,392,870 | 7/1968 | Schulz | 220/334 |
| 3,420,570 | 1/1969 | Kunz | 220/335 |
| 3,463,345 | 8/1968 | Bockenstette . | |
| 4,213,539 | 7/1980 | Reuter | 220/343 |
| 4,364,489 | 12/1982 | Alexeeff | 220/334 |
| 4,391,386 | 7/1983 | Moret . | |
| 4,432,467 | 2/1984 | Swingley Jr. | 220/334 |
| 4,620,445 | 11/1986 | Miller | 220/334 |
| 4,685,567 | 8/1987 | Webb . | |
| 4,765,480 | 8/1988 | Malmanger . | |

FOREIGN PATENT DOCUMENTS

| | | | |
|---|---|---|---|
| 2241492 | 9/1991 | United Kingdom | 220/334 |

*Primary Examiner*—Joseph M. Moy

*Attorney, Agent, or Firm*—Fay, Sharpe, Beall, Fagan, Minnich & McKee

[57] ABSTRACT

A pair of bi-fold lids covers a container having a depth dimension that is less than half the width dimension of the container. Each bi-fold lid has front and rear sections that are hinged together along a hinge axis. The hinge axis is reinforced by adjacent flanges that overlap one another when the lids are in their closed position. When the lids are open, the front and rear sections fold over on one another to reduce the extent to which they hang down adjacent the sidewall of the container. This permits a container of short height or shallow depth to have lids.

4 Claims, 6 Drawing Sheets 20
13
31
21
22
25
32
18
17
5
6
7

BI-FOLD LID FOR CONTAINER

BACKGROUND OF THE INVENTION

1. Field of the Invention

The invention relates to hi-fold lids hinged to the sidewalls of a container that has a width dimension that exceeds twice its depth dimension. In particular each lid has two sections hinged to one another that extend across the opening of the container in a closed position and fold back onto each other when the lids are rotated to an open position.

2. Description of the Related Art

Conventional lidded containers have a depth dimension that exceeds the width dimension across the open top of the container. As a result, when the lids, which are hinged to the sidewalls of the container, are opened, the lids rotate approximately 270° to a position substantially parallel with the sidewalls. This permits the containers to be shipped in a nested stack with the lids open without a substantial change in the overall dimension of the container, as compared to when the lids are in the closed position.

When a container is designed to have a width dimension between the sidewalls to which the lids are hinged that exceeds the depth of the container, the lids rotate to an open position, but are prevented from rotating the full 270° as a result of interference with the floor or other support surface supporting the container. As a result, when empty containers of such dimensions are stacked in a nested stack, the lids of the bottom container engage the support surface causing them to flare outwardly to a significant degree thus changing the overall dimension of the container, as compared with its dimension when the lids are closed. Thus lidded containers of shallow depth are not in wide circulation.

SUMMARY OF THE INVENTION

It is an object of the invention to provide bi-fold lids hinged to the sidewalls of a container having a width dimension (between the sidewalls) that exceeds its depth dimension. Each bi-fold lid has two sections that are hinged together along a hinge joint extending parallel to the sidewalls. As a result, when the lids hinged to the sidewalls are opened by rotation about their hinge axis of approximately 270°, the bi-fold lid sections rotate about their common hinge axis approximately 180° with respect to each other so that the lid sections fold toward each other and lay flat together when the lids are in their fully opened position. This results in the width dimension of each lid being reduced by one-half and prevents the lids from interfering with the floor or other support surface on which the container is supported when the lids are rotated to their fully open position.

The containers for which the lids of the present invention are designed are stackable with the lids in their closed position and nestable with the lids in their fully open position. As a result of preventing the interference of the lid with the floor or other support surface when the lids are in their fully open position, the containers have an overall dimension that is substantially similar to the dimension of the container with the lids in their closed position.

When the containers are stacked on one another with their lids in the closed position, the weight of the stack creates a substantial load on the lids at the bottom of the stack. The weight of the load is distributed across the mid-portions of the lids, and the lids tend to separate where they are joined across the mid-portion of the container opening. For a bi-fold lid, this problem is magnified in that the lids also tend to separate across the hinge line joining each bi-fold lid section. Accordingly, it is an object of the present invention to insure that the hinge joint between the bi-fold lid sections does not separate when subjected to a load from a stack of containers or other similar loads placed on them.

It is an object of the invention to provide a hinge joint between two sections of a hi-fold lid that is able to withstand a load by providing each lid section with a joint structure that permits rotation about the joint of approximately 180° and also provides cooperating flanges adjacent the hinge axis that overlap one another to strengthen the hinge joint when the lids are in their closed position. It is a further object of the invention that the overlapping flanges do not interfere with rotation of the bi-fold lid sections when lids are rotated to their open position and the hi-fold lid sections are rotated by about 180° with respect to each other about the hinge axis.

An additional object of the invention is to provide the bottom surfaces of each section with rib structure such that after completing about 180° of rotation about the hinge joint, the bottom surfaces closely abut and partially interfit with one another to reduce the overall thickness of the folded lid sections.

It is yet another object of the invention to provide the hi-fold lid sections with interengaging structure to maintain the lid sections in folded relationship when in the fully open position. Preferably, the interengaging structure includes an upstanding flange projecting downwardly from a bottom wall of one of the lid sections that engages a mating rib, flange or edge of a structure on the other of the lid sections in a resilient manner to enable the lid sections to be snapped together and pulled apart when in their open position.

DETAILED DESCRIPTION OF THE PREFERRED EMBODIMENTS

Figure 1:
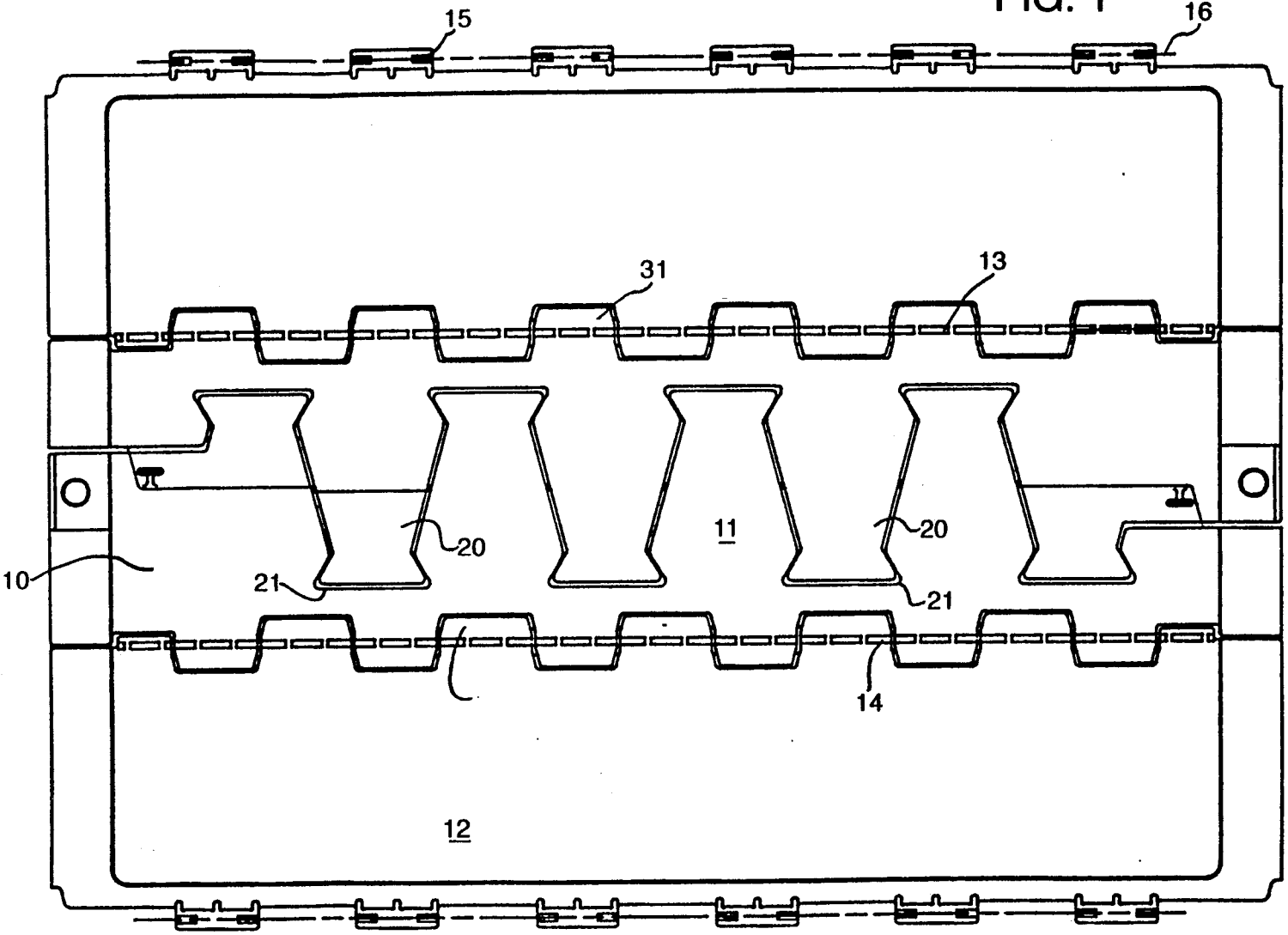
FIG. 1 is a top view of the bi-fold lids of the present invention shown in the closed position.
Figure 2:
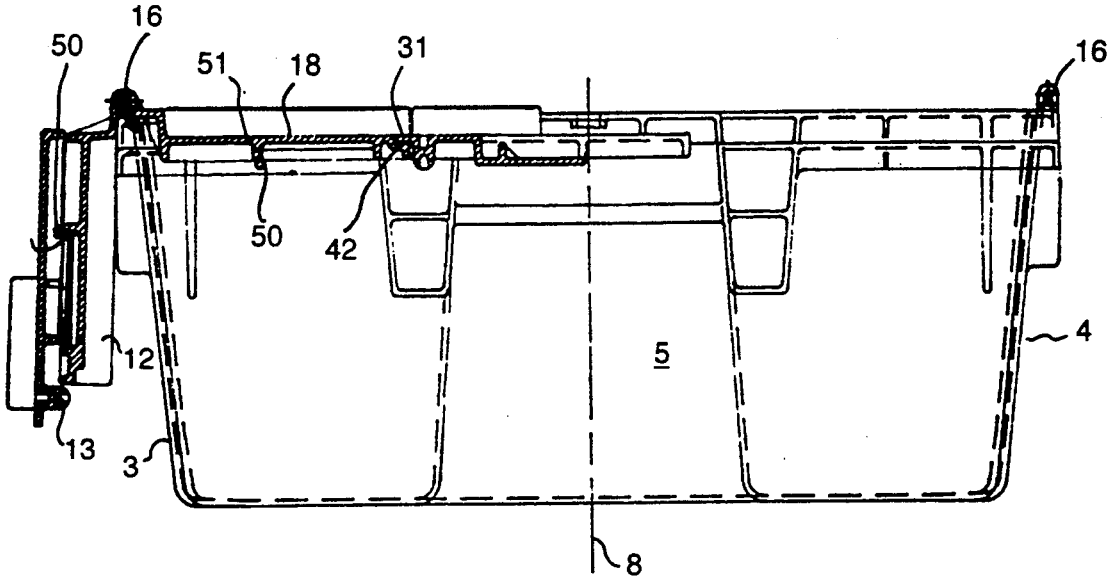
FIG. 2 is an end view of a container showing one bi-fold lid in each of the open and closed positions.

The bi-fold lids of the present invention are designed for containers having a broad width dimension that exceeds twice its depth dimension. An example of such a container is shown in FIG. 1. The container 1 has an open top 2, opposite sidewalls 3, 4 and opposite endwalls. Only one of the endwalls, endwall 5 is shown in FIG. 2. The depth of container 1 from the top 2 to a bottom wall 7 is less than one-half the width dimension of the container between sidewalls 3, 4. Accordingly, conventional lids of one piece construction hinged to the sidewalls and joined together across the center line 8 of the container cannot swing to a fully open position through approximately 270° since the ends of such lids would hang down below the bottom wall 7 and engage with a support surface, such as a floor, that supports the container. Accordingly, the present invention is directed to solving this problem with the conventional one-piece lid by providing a bi-fold lid constructed in two pieces that are hinged together.

Figure 3:
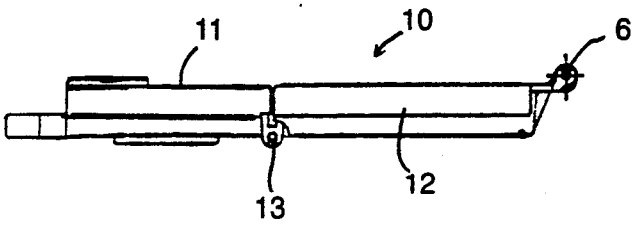
FIG. 3 is an end view of the bi-fold lid of the present invention not attached to a container, yet shown in a fully open position.

As shown in FIGS. 1 and 3, each bi-fold lid 10 is a mirror image of the other and is constructed of two sections, mainly a front section 11 and a rear section 12. Front and rear sections 11, 12 are preferably joined together by a hinge pin, not shown, that fits in a hinge groove 13 running along hinge axis 14. Also as shown in FIGS. 1 and 3, the rear sections 12 are preferably hinged to the sidewalls 3, 4 by a hinge pin, not shown, that fits in a hinge groove 15 extending along a hinge axis 16. Alternatively, the rear sections 12 may be hinged to the endwalls 5, 6, using a similar construction. Moreover, although a pin-groove construction is preferred, other suitable hinge structures may be used; for example, a living hinge may be provided instead of one or both of these pin-groove hinges.

When the bi-fold lids 10 are in their closed position, as shown in FIG. 1, the front section 11 of the lids interlock with each other. In particular, as shown in FIGS. 1, 4, 8 and 9 each front lid section has a plurality of fingers 20 and finger receiving pockets 21 formed between the fingers. Pockets 21 are recessed with respect to fingers 20 and have upstanding ribs 22 that engage with downwardly extending ribs 23 at the end of each of the fingers 20, shown in FIG. 9. Further, fingers 20 have outwardly flaring terminal portions 24 that are received within correspondingly shaped end portions 25 of pockets 21. The engagement of fingers 20 in pockets 21 provides a strong closure between lids 10 that resists separation, even when heavy loads are placed on the lids.

Figures 4, 5, 6, 7, 8:
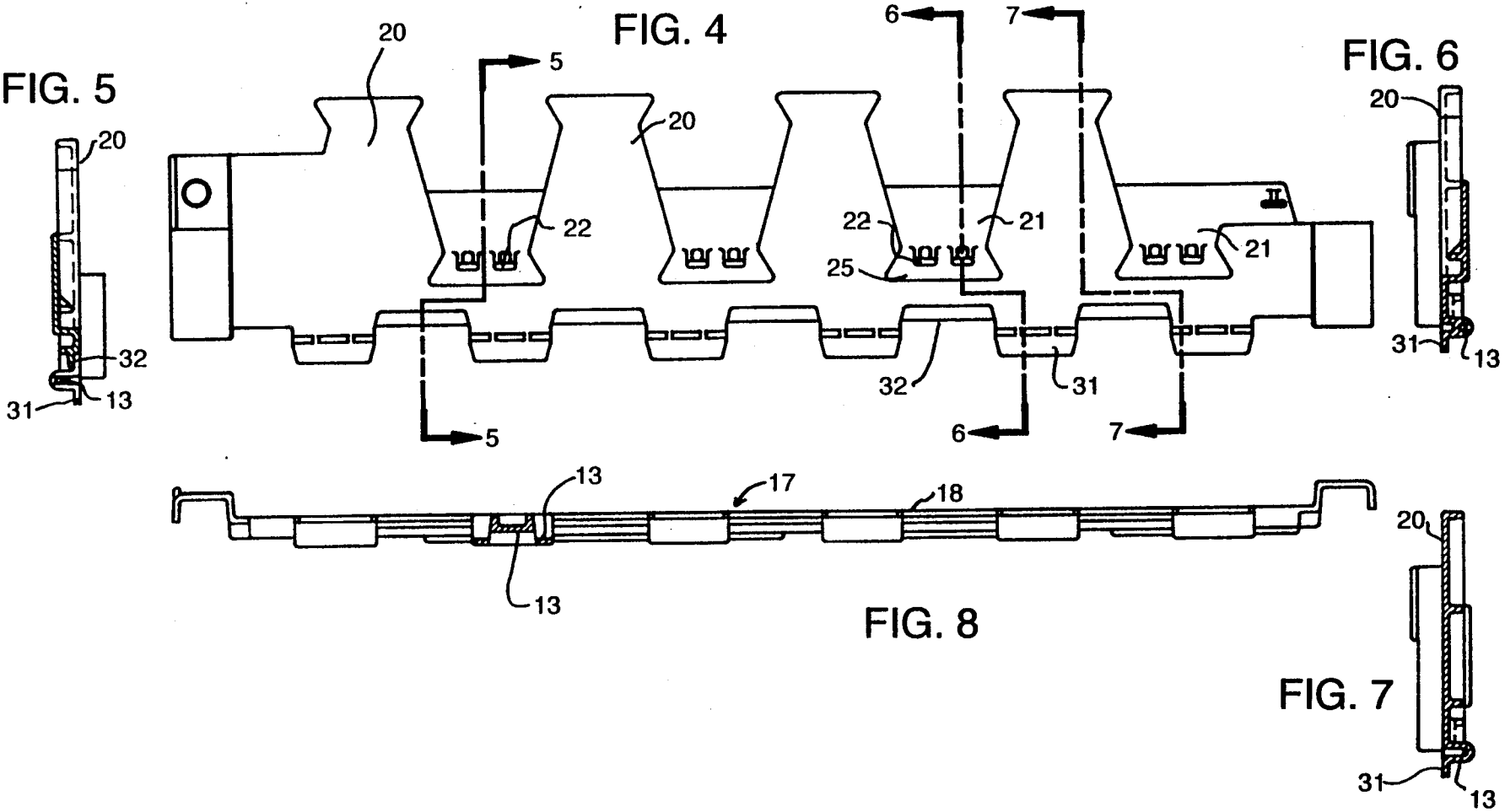
FIG. 4 is a top view of the front section of a bi-fold lid constructed according to the present invention and shown in FIGS. 1-3.
FIG. 5 is a sectional view taken along section line 5—5 in FIG. 4.
FIG. 6 is a sectional view taken along line 6—6 in FIG. 4.
FIG. 7 is a sectional view taken along line 7—7 in FIG. 4.
FIG. 8 is a side view of the front lid section shown in FIG. 4.

In FIG. 8, the bi-fold lids are shown as having a generally recessed mid-portion 17 having a top surface 18. When the containers 1 are stacked with the lids 10 in their closed position, the bottom wall 7 of one container rests on the mid-portion 17 creating a load on the joint formed between lids 10 by fingers 20 and pockets 21, and on the hinge joint formed between the front and rear sections of 11, 12 of each of the lids 10. Accordingly, the hinge Joint formed between the front and rear sections 11, 12 of each of the bi-fold lids 10 is strengthened to withstand such loads.

Figure 11:
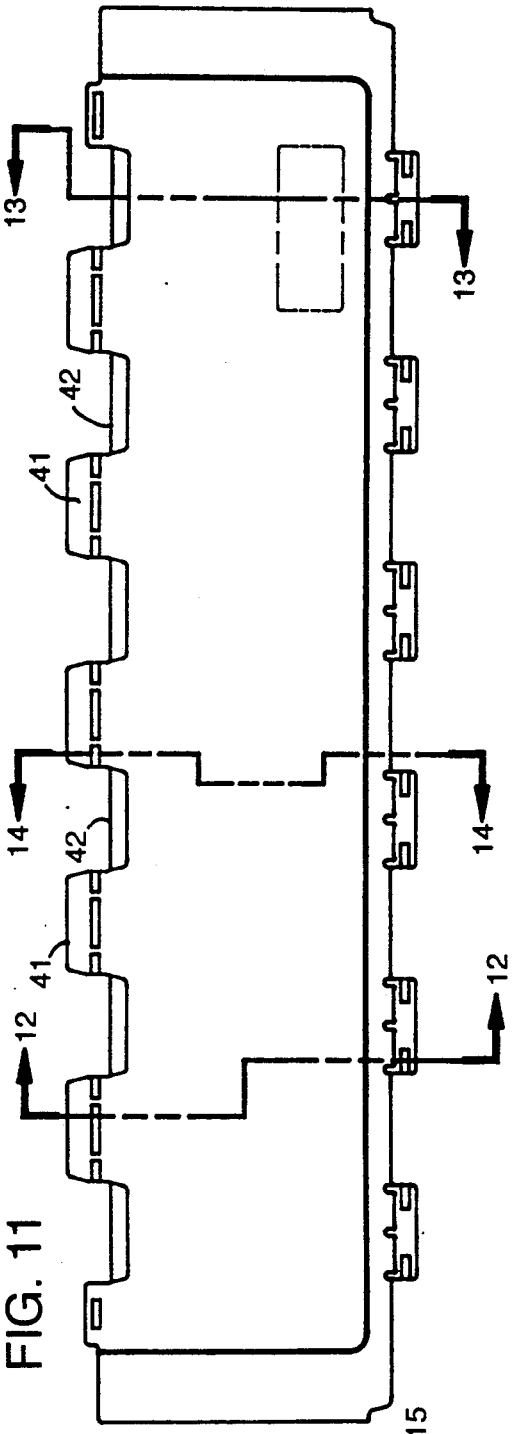
FIG. 11 is a top view of the rear section of the bi-fold lid shown in FIGS. 1-3.

As shown in FIG. 1, and as shown in FIGS. 4 and 11, the front and rear sections 11, 12 of each bi-fold lid 10 have a plurality of outwardly extending flanges that extend beyond the hinge axis 14 and recess flanges that extend inwardly of the hinge axis 14 that are formed between the outwardly extending flanges. More specifically, FIG. 4 shows the outwardly extending flanges 31 and adjacent flanges 32 that extend inwardly of the hinge axis 14. In FIG. 11, the outwardly extending flanges 41 for the rear bi-fold lid section 12 are shown with adjacent flanges 42 extending inwardly of the hinge axis 14. When the bi-fold lid is extended in its open position, the outwardly extending flanges 31 of front bi-fold lid section 11 overlap flanges 42 of rear bi-fold lid section 12, and similarly outwardly extending flanges 41 of lid section 12 overlap flanges 32 of lid section 11. The engagement of the hinged flange structure is shown in FIG. 2 wherein the bi-fold lid is shown in the open position, partially in section.

Although the overlapping flange arrangement is a preferred embodiment due to the additional strength lent to the hinge formed at the hinge axis 14, which is particularly advantageous when multiple containers are stacked, the overlapping flanges may be omitted in favor of a simpler, though weaker, arrangement that relies more heavily on the hinge itself for support.

Figure 13:
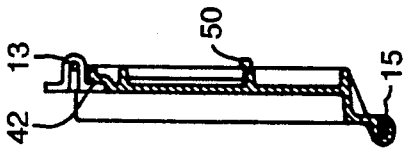
FIG. 13 is a sectional view taken along line 13—13 in FIG. 11.
Figure 14:
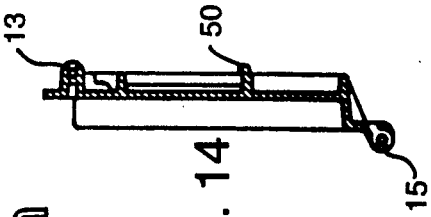
FIG. 14 is a sectional view taken along line 14—14 in FIG. 11.
Figure 12:
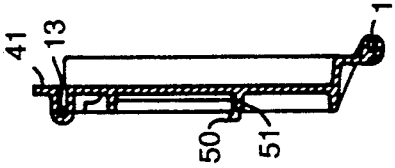
FIG. 12 is a sectional view taken along line 12—12 in FIG. 11.

The outwardly extending flanges 31, 41 have a top surface that is even with the top surface 18 of recessed mid-portion 17. Correspondingly, flanges 32, 42 are recessed with respect to the top surface 18 to permit the overlapping of the flanges that strengthen the hinge joint between the lid sections. FIG. 5 shows a sectional view through a recessed flange 32 for lid section 11 and FIG. 13 shows a sectional view through flange 42, showing how it is recessed. Furthermore, FIGS. 6 and 7 show sectional views through the outwardly extending flanges 31 of front lid section 11 and FIGS. 12 and 14 show sectional views through outwardly extending flanges 41 of lid section 12.

Figure 15:
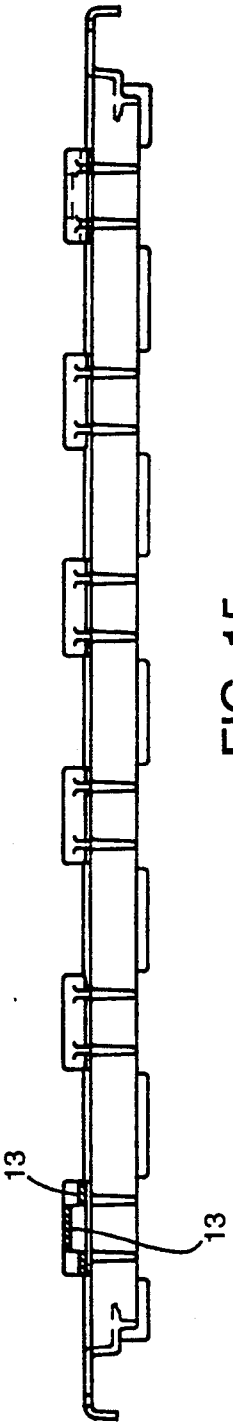
FIG. 15 is a side view of the rear bi-fold lid section shown in FIG. 11.

The hinge groove 13 extends through both outwardly extending flanges 31 and 41 of the lid sections. FIGS. 6, 7 and 8 show sectional views of the portion of the hinge groove that runs through the lid section 11 and FIGS. 12 and 14 show sectional views of the hinge groove 13 that extends through lid section 12. The hinge groove is formed by providing alternating upwardly and downwardly extending groove portions, which are molded by conventional techniques. A similar hinge forming technique between rear lid section 12 of the bi-fold lid and the sidewalls 3, 4 is used, as shown in FIGS. 1 and 2, as well as in FIGS. 12, 13 and 15.

Figure 9:
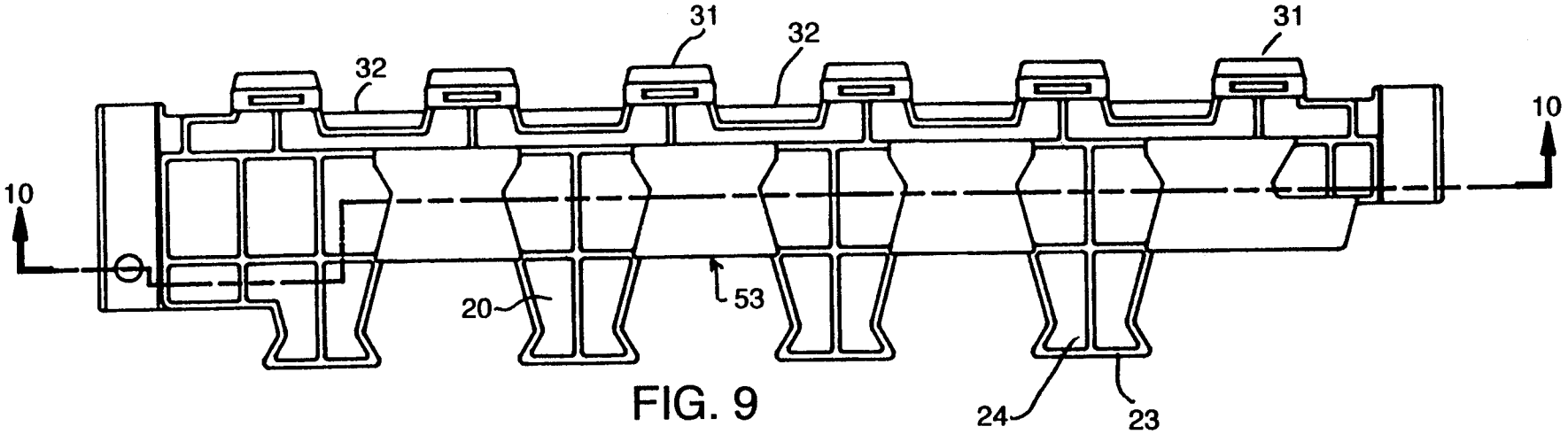
FIG. 9 is a bottom view of the front lid section shown in FIG. 4.
Figure 10:
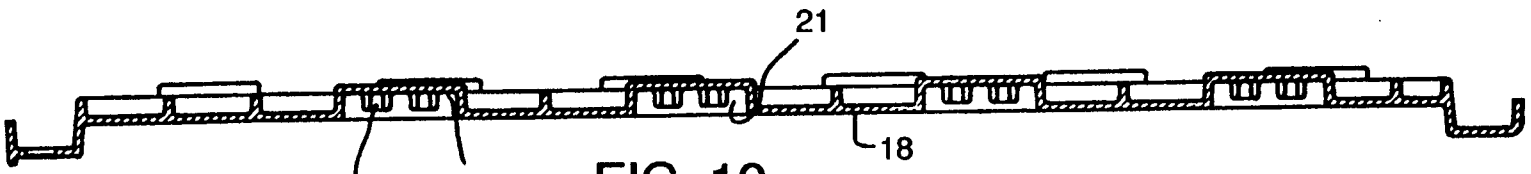
FIG. 10 is a sectional view taken along line 10—10 in FIG. 9.
Figure 16:
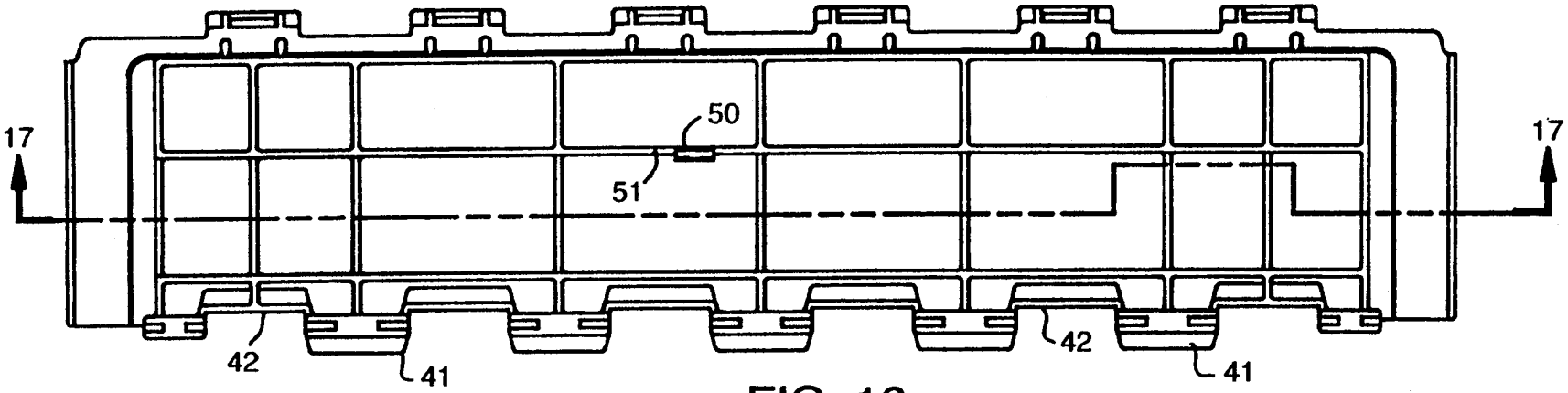
FIG. 16 is a bottom view of the rear bi-fold lid section shown in FIG. 11.
Figure 17:
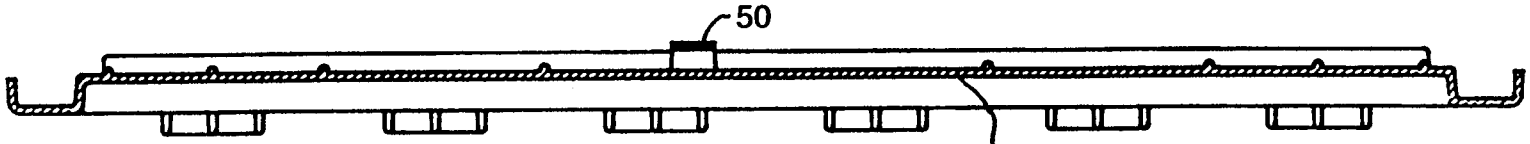
FIG. 17 is a sectional view taken along line 17—17 in FIG. 16.

FIG. 2 shows one bi-fold lid in the folded position adjacent sidewall 3. To maintain the lid in its folded position when open, a downwardly extending or depending tab 50 is provided along a rib 51, shown in FIGS. 16 and 17 which are a bottom view of the rear lid section 12 and a sectional view taken along line 17—17 in FIG. 16, respectively. As shown in FIG. 2, tab 50 engages a free edge portion 53 of a pocket 21 in the middle of front lid section 11, as shown in FIG. 9. Preferably, tab 50 is sufficiently resilient to snap over free edge portion 53 to secure the lid sections together when in their folded, open position. As shown in FIG. 10, the pockets 21 are recessed, and therefore the free edge 53 of the pocket 21 shown in FIG. 9 is spaced closely to the bottom wall of rear lid section 12 making engagement between tab 50 and free edge 53 convenient.

Although the preferred embodiment of the invention has been described with reference to the accompanying figures, those skilled in the art will recognize that variations and changes may be made without departing from the spirit and scope of the invention.

What is claimed is

1. A pair of bi-fold lids for covering an open top of a container, each of said bi-fold lids being hinged to a top of one of a sidewall and an endwall of the container and being joined across a mid-portion of the open top to form a joint when the lids are in a closed position, comprising:

each said bi-fold lid having front and rear sections hinged together along a hinge joint and each of said front and rear sections having flanges extending outwardly beyond a hinge axis of said hinge joint and recessed flanges extending inwardly of the hinge axis and formed between said outwardly extending flanges, wherein the outwardly extending flanges of one of said sections overlap corresponding positioned recessed flanges of the other said sections to strengthen the hinge joint between said sections.

2. A container having bi-fold lids, said container having opposed side and endwalls alternately joined together with a bottom wall and having an open top, each of said bifold lids being identical but in facing relation with a first edge of each said lid being hinged to a top portion of the sidewalls of the container and second edges of the lids extending parallel to said first edges and facing each other to form a joint therebetween when the lids are in a closed position, comprising:

said bi-fold lids having front and rear sections hinged together along a hinge axis; and each of said front and rear sections of each said bi-fold lid having reinforcing flanges that overlap one another along the hinge joint to strengthen the hinge joint between said front and rear sections of each said lid.

3. A container according to claim 2, wherein each said lid has a plurality of fingers along said second edges and a plurality of pockets formed between said fingers along said second edges, said fingers being received within said pockets to form said joint between said lids when said lids are in the closed position.

4. A bi-fold lid according to claim 1, wherein said front and rear sections of each of said lids have interengaging structure for maintaining the front and rear sections in folded relationship when said lid is in an open position.

* * * * *